US011767686B2

(12) United States Patent
Chen et al.

(10) Patent No.: US 11,767,686 B2
(45) Date of Patent: Sep. 26, 2023

(54) INTELLIGENT CABINET SYSTEM AND LOCKING MECHANISM THEREFOR

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Chun-Ta Liu, Kaohsiung (TW); Hsin-Cheng Su, Kaohsiung (TW); Chih-Te Chuang, Kaohsiung (TW); Shu-Chen Lin, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 277 days.

(21) Appl. No.: 17/472,878

(22) Filed: Sep. 13, 2021

(65) Prior Publication Data

US 2022/0403678 A1 Dec. 22, 2022

(30) Foreign Application Priority Data

Jun. 16, 2021 (TW) ..... 110122262

(51) Int. Cl.

| | |
|---|---|
| ***E05B 47/00*** | (2006.01) |
| ***A47B 88/427*** | (2017.01) |
| ***E05B 47/06*** | (2006.01) |
| ***E05B 65/46*** | (2017.01) |
| ***E05B 65/52*** | (2006.01) |

(52) U.S. Cl.

CPC ..... *E05B 47/0001* (2013.01); *A47B 88/427* (2017.01); *E05B 47/06* (2013.01); *E05B 65/46* (2013.01); *E05B 65/523* (2013.01); *E05B 2047/0037* (2013.01)

(58) Field of Classification Search

None

See application file for complete search history.

(56) References Cited

U.S. PATENT DOCUMENTS

| | | | |
|---|---|---|---|
| 8,328,299 | B2 | 12/2012 | Hashemi et al. |
| 10,258,155 | B2 | 4/2019 | Chen et al. |

(Continued)

FOREIGN PATENT DOCUMENTS

| | | | |
|---|---|---|---|
| CN | 211533445 | U | 9/2020 |
| FR | 2226857 | A5 | 11/1974 |

(Continued)

*Primary Examiner* — K. Wong

(57) ABSTRACT

A locking mechanism is applicable to an intelligent cabinet system having a first object and a second object movable relative to each other. The second object is configured to be located at one of a retracted position, a predetermined extension position and an open position. The locking mechanism includes a locking member and a driving device. The driving device is configured to drive the locking member to move from a first predetermined position to a second predetermined position. When the second object is moved relative to the first object from the retracted position along a direction and when the locking member is located at the second predetermined position, the locking member is configured to block the second object at the predetermined extension position. The predetermined extension position is located between the retracted position and the open position.

20 Claims, 15 Drawing Sheets

(56) References Cited

U.S. PATENT DOCUMENTS

| | | | | |
|---|---|---|---|---|
| 2006/0237427 | A1* | 10/2006 | Logan | G07C 9/37 219/401 |
| 2009/0102207 | A1 | 4/2009 | Kim | |
| 2020/0018098 | A1 | 1/2020 | Chen et al. | |

FOREIGN PATENT DOCUMENTS

| | | | |
|---|---|---|---|
| JP | 2010174516 | A | 8/2010 |
| JP | 2019005541 | A | 1/2019 |
| JP | 2020007899 | A | 1/2020 |
| WO | WO0073608 | A1 | 12/2000 |
| WO | WO2021032676 | A1 | 2/2021 |

* cited by examiner

INTELLIGENT CABINET SYSTEM AND LOCKING MECHANISM THEREFOR

BACKGROUND OF THE INVENTION

1. Field of the Invention

The present invention relates to a locking mechanism, and more particularly, to a locking mechanism applicable to objects movable relative to each other.

2. Description of the Prior Art

Generally, a slide rail assembly is applicable to a rack system of an electronic device in home or an office. The slide rail assembly comprises a first rail and a second rail respectively mounted to a first object and a second object, such as a cabinet body and a drawer, such that the drawer can be opened or retracted relative to the first rail and/or the cabinet body through the second rail.

For different market requirements, some user may not want the second rail (the second object) to be moved freely relative to the first rail (the first object) from a predetermined position.

US patent publication number US 2020018098A1 discloses a lock mechanism configured to be arranged on one of a first object and a second object movable relative to each other. The lock mechanism comprises a driving device and a locking member. The locking member is configured to be driven by the driving device (such as a motor) to move from a first position to a second position in a non-rotatable manner. When the locking member is located at one of the first position and the second position, the locking member is configured to lock the other one of the first object and the second object. When the locking member is located at the other one of the first position and the second position, the locking member does not lock the other one of the first object and the second object.

U.S. Pat. No. 8,328,299 B2 discloses a drawer slide and a lock mechanism. The lock mechanism is an electric lock. As shown in FIG. 1 of the case, the drawer slide comprises an outer slide member and an inner slide member. The inner slide member is located at a closed position relative to the outer slide member. A rear end of the inner slide member is arranged with a pin. On the other hand, the lock mechanism comprises a latch receiver, a lever arm and a motor. As shown in FIG. 1 and FIG. 2 of the case, the latch receiver is configured to be located at a first position. When being located at the first position, the latch receiver is ready to capture the pin of the inner slide member. As shown in FIG. 3 of the case, when receiving an electronic control signal, the motor is configured to drive the lever arm to rotate, such that a top portion of the lever arm is rotated to push the latch receiver to rotate from the first portion to a second position and retain the pin of the inner slide member. According to such arrangement, the inner slide member can be held at the closed position relative to the outer slide member.

Furthermore, both of the aforementioned cases use the motor to drive the lever arm. However, constantly turning on and off the motor for controlling rotation of the level arm usually consumes more power, which is unfavorable to long-term use of a battery. Moreover, for different market requirements or structural considerations, sometimes it is not desirable to use such arrangement for realizing a locking function. Therefore, it is important to develop different types of products.

SUMMARY OF THE INVENTION

The present invention relates to a locking mechanism which is applicable to an object movable relative to the locking mechanism.

According to an embodiment of the present invention, an intelligent cabinet system comprises a first object, a second object, a locking mechanism, and a controller. The second object is movable relative to the first object. The locking mechanism comprises a locking member. The controller configured to communicate with an electronic device for receiving a first control signal from the electronic device. The second object is movable relative to the first object from a retracted position to an open position. When the electronic device transmits the first control signal to the controller, and when the second object is moved relative to the first object from the retracted position along an opening direction, the controller is configured to control the locking member of the locking mechanism to move from a first predetermined position to a second predetermined position according to the first control signal, in order to block the second object at a predetermined extension position by the locking member. The predetermined extension position is located between the retracted position and the open position.

Preferably, the first object is a cabinet body, and the second object is a drawer or a door.

Preferably, the electronic device and the controller are configured to communicate with each other through wireless transmission.

Preferably, the locking mechanism further comprises a sensor configured to detect whether the second object is located at the retracted position.

Preferably, when the second object is located at the retracted position, the locking member is located at the first predetermined position. When the second object is moved away from the retracted position along the opening direction, the sensor is configured to generate a first sensing signal accordingly; and when the controller determines that the second object is moved away from the retracted position according to the first sensing signal, the controller is configured to control the locking member of the locking mechanism to move from the first predetermined position to the second predetermined position according to the first control signal in order to block the second object at the predetermined extension position.

Preferably, when the controller determines that the second object is moved away from the retracted position for a predetermined time according to the first sensing signal, the controller is configured to transmit a notification signal to the electronic device.

Preferably, when the electronic device transmits a second control signal to the controller, the controller is configured to control the locking member of the locking mechanism to be located at the first predetermined position according to the second control signal, to allow the second object to move along the opening direction to the open position without being blocked at the predetermined extension position by the locking member.

Preferably, the intelligent cabinet system further comprises a power storage device, and the locking mechanism further comprises a driving device. The power storage device is configured to supply power to the driving device.

Preferably, when the controller receives the first control signal and the driving device is powered, the driving device is configured to drive the locking member to move from the first predetermined position to the second predetermined position. When the controller receives the second control signal, the driving device is not powered, and the locking member is located at the first predetermined position.

Preferably, the intelligent cabinet system further comprises a locking buckle. The locking mechanism is arranged on one of the first object and the second object, and the locking buckle is arranged on the other one of the first object and the second object. When the locking member of the locking mechanism is located at the second predetermined position, the locking member of the locking mechanism is configured to block the locking buckle, in order to block the second object at the predetermined extension position.

According to another embodiment of the present invention, a locking mechanism is configured to be mounted to one of a first object and a second object movable relative to each other. The second object is movable relative to the first object to be located at one of a retracted position, a predetermined extension position and an open position. The locking mechanism comprises a locking member and a driving device. The driving device is configured to drive the locking member to move from a first predetermined position to a second predetermined position. When the second object is moved relative to the first object from the retracted position along an opening direction and when the locking member is located at the second predetermined position, the locking member is configured to block the second object at the predetermined extension position. The predetermined extension position is located between the retracted position and the open position.

Preferably, when the second object is moved relative to the first object from the retracted position along the opening direction and when the locking member is located at the first predetermined position, the second object is movable along the opening direction to the open position without being blocked at the predetermined extension position by the locking member.

Preferably, the locking mechanism further comprises a sensor configured to detect whether the second object is located at the retracted position.

Preferably, the locking mechanism further comprises a power storage device configured to supply power to the driving device.

Preferably, the locking mechanism comprises a controller configured to receive a first control signal or a second control signal of an electronic device. When the controller receives the first control signal and the second object is moved away from the retracted position along the opening direction, the driving device is powered and configured to drive the locking member to move from the first predetermined position to the second predetermined position. When the controller receives the second control signal and the second object is moved away from the retracted position along the opening direction, the driving device is not powered such that the locking member is located at the first predetermined position.

Preferably, the locking mechanism further comprises a rotating mechanism. The driving device is configured to drive the locking member to move from the first predetermined position to the second predetermined position through the rotating mechanism.

Preferably, the locking mechanism further comprises an elastic member. When the controller receives the second control signal and the second object is moved away from the retracted position along the opening direction, the driving device is not powered, and the locking member is held at the first predetermined position in response to an elastic force of the elastic member.

Preferably, the locking mechanism further comprises a sliding block. The driving device is configured to drive the locking member to move from the first predetermined position to the second predetermined position through the sliding block.

Preferably, the locking mechanism further comprises an elastic member. When the controller receives the second control signal and the second object is moved away from the retracted position along the opening direction, the driving device is not powered, and the locking member is held at the first predetermined position in response to an elastic force of the elastic member.

Preferably, the locking mechanism further comprises a locking buckle and a fixing base. The locking buckle is arranged on the other one of the first object and the second object. When the locking member of the locking mechanism is moved from the first predetermined position to the second predetermined position, the locking member of the locking mechanism is configured to block the locking buckle, in order to block the second object at the predetermined extension position; wherein the fixing base is configured to keep a moving direction of the locking member perpendicular to a moving direction of the locking buckle.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
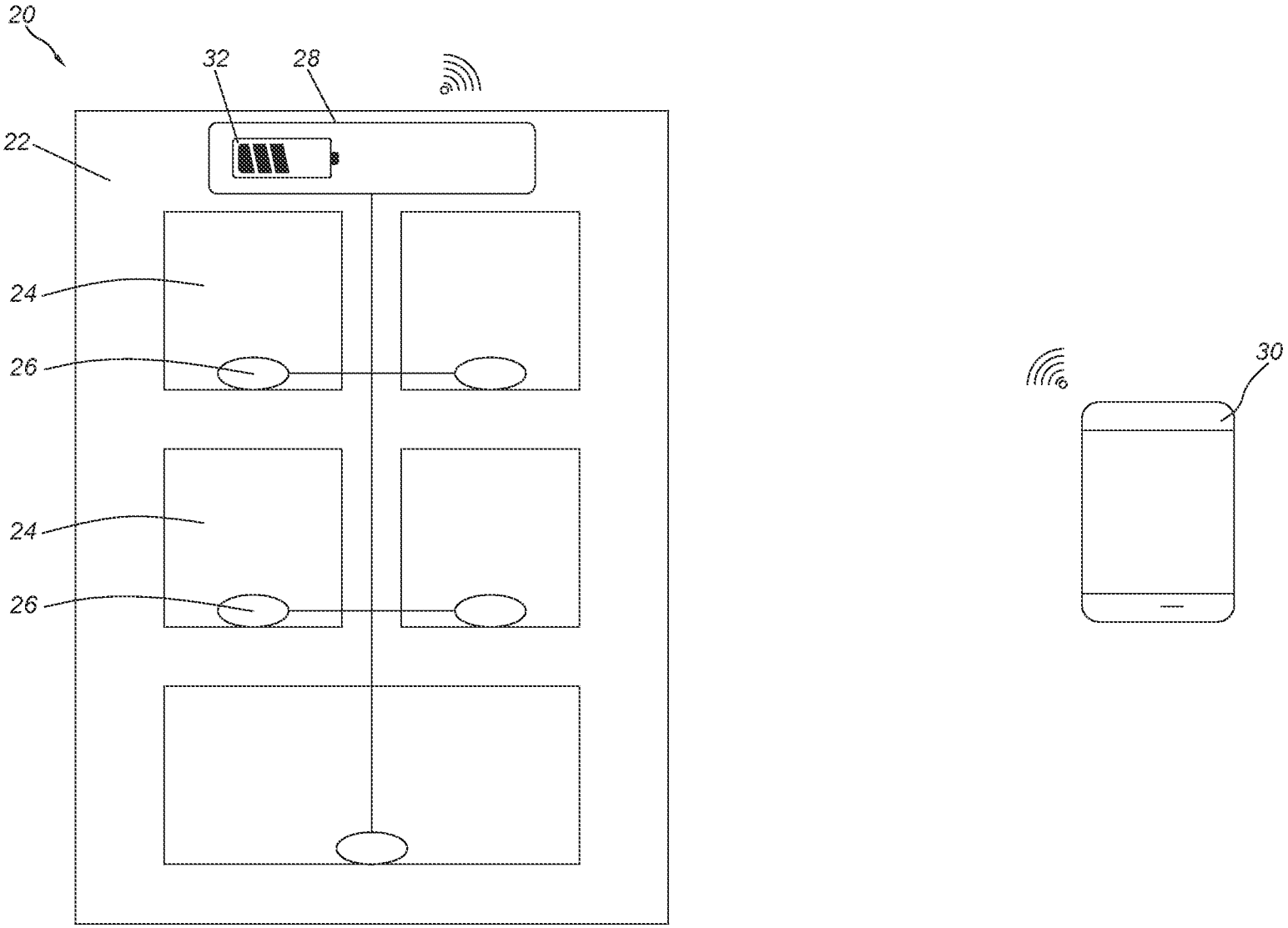
FIG. 1 is a diagram showing an intelligent cabinet system according to a first embodiment of the present invention.

As shown in FIG. 1, an intelligent cabinet system 20 comprises a first object 22, at least one second object 24, at least one locking mechanism 26 and a controller 28 according to a first embodiment of the present invention. Preferably, the intelligent cabinet system 20 further comprises a power storage device 32.

The first object 22 and the at least one second object 24 are movable relative to each other. In the present embodiment, the first object 22 is a cabinet body, and the at least one second object 24 is a drawer or a door, but the present invention is not limited thereto. Furthermore, if the at least one second object 24 is a drawer, the first object 22 and the second object 24 can be equipped with a retractable slide rail assembly, such as a steel ball slide rail assembly or a hidden slide rail assembly. If the at least one second object 24 is a door, the first object 22 and the second object 24 can be equipped with a hinge.

The controller 28 is configured to communicate with an electronic device 30, such that the electronic device 30 and the controller 28 can transmit data to each other. For example, the electronic device 30 can transmit at least one control signal to the controller 28, and the controller 28 can electrically control the at least one locking mechanism 26 accordingly.

The power storage device 32 is configured to supply power to the controller 28 or other related electronic components electrically connected to the controller 28.

Preferably, the electronic device 30 is configured to communicate with the controller 28 through wireless transmission. The wireless transmission can be WIFI, RFID, Bluetooth, Sub_1 Ghz, LoRa or NFC, but the present invention is not limited thereto.

Preferably, the electronic device 30 can be a mobile phone, a tablet device, or a smart watch, but the present invention is not limited thereto.

Preferably, the power storage device 32 can comprise a disposable battery, a rechargeable battery, or various types of lithium batteries. The rechargeable battery can be charged through an AC/DC adaptor or a wireless charging device, but the present invention is not limited thereto.

Figure 2:
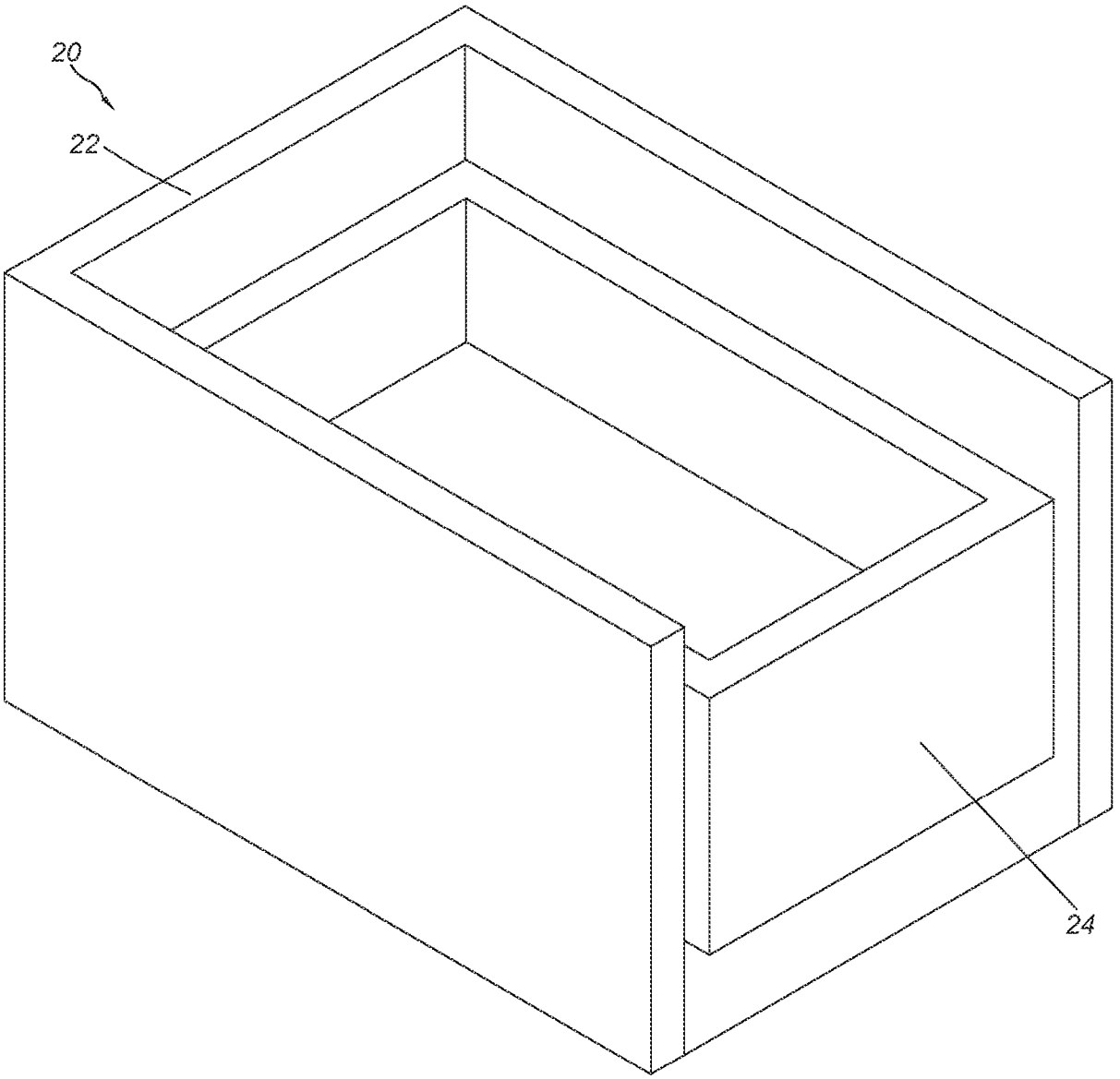
FIG. 2 is a diagram showing the intelligent cabinet system with a drawer according to the first embodiment of the present invention.
Figure 3:
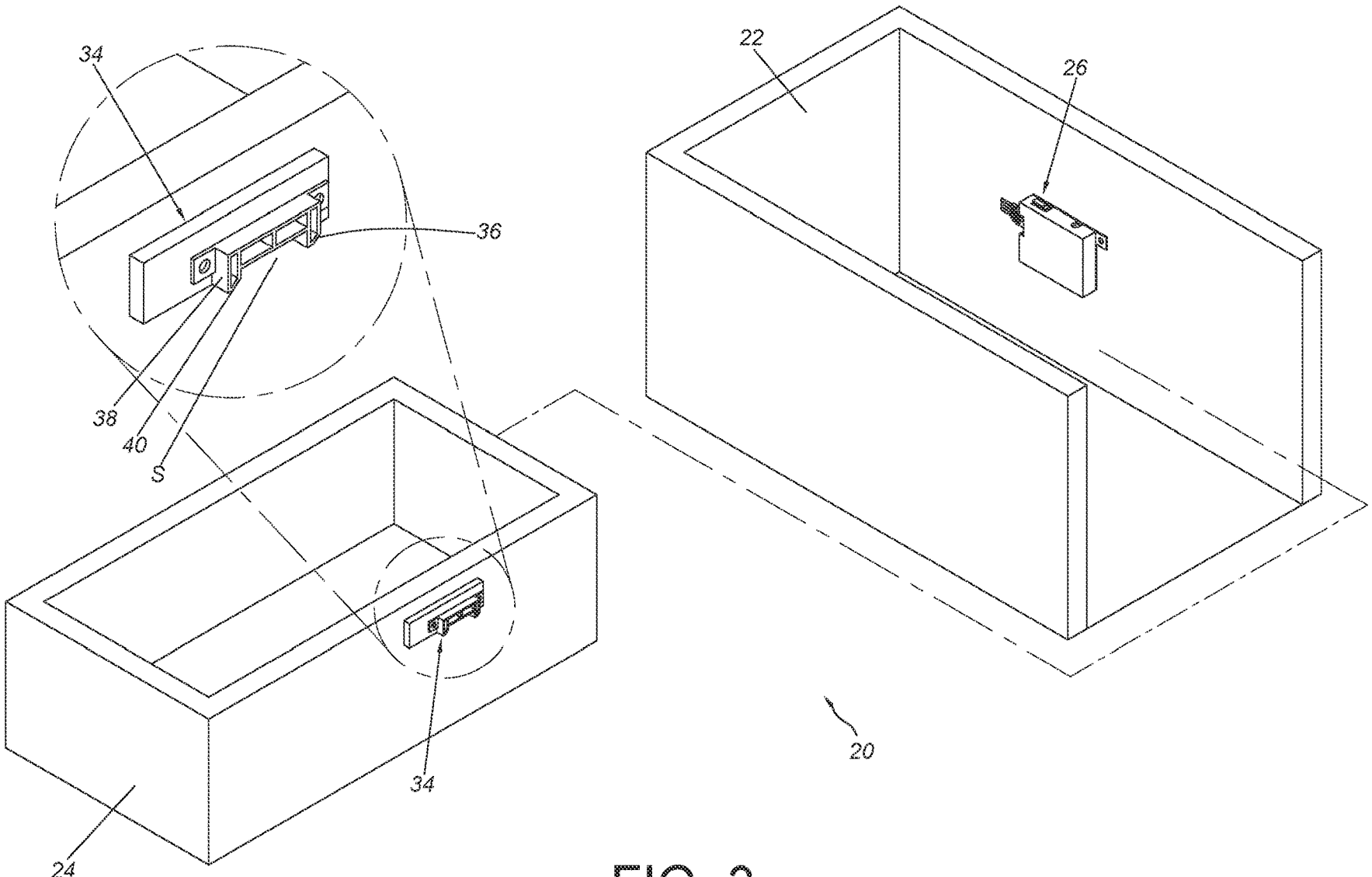
FIG. 3 is an exploded view of the intelligent cabinet system with the drawer according to the first embodiment of the present invention.

As shown in FIG. 2 and FIG. 3, the first object 22 of the intelligent cabinet system 20 is a cabinet body and the second object 24 is a drawer for example. Preferably, the cabinet body is configured to be arranged with a first rail (not shown in figures), and the drawer is configured to be arranged with a second rail (not shown in figures). The second rail is configured to assist the drawer in moving relative to the cabinet body. The first rail can be regarded as one part of the first object 22, and the second rail can be regarded as one part of the second object 24.

Preferably, the intelligent cabinet system 20 further comprises a locking buckle 34. The locking mechanism 26 is arranged on one of the first object 22 and the second object 24, and the locking buckle 34 is arranged on the other one of the first object 22 and the second object 24. In the present embodiment, the locking mechanism 26 is arranged on the first object 22 and the locking buckle 34 is arranged on the second object 24, but the present invention is not limited thereto.

Preferably, the locking buckle 34 comprises a first part 36, a second part 38 and a space S defined between the first part 36 and the second part 38.

Preferably the second part 38 has a guiding feature 40. The guiding feature 40 has an inclined surface or an arc surface, but the present invention is not limited thereto.

Figure 4:
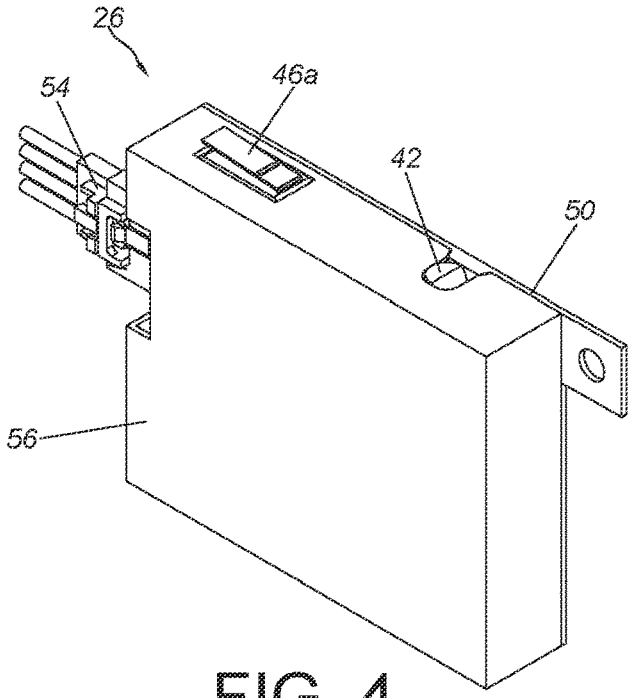
FIG. 4 is a diagram showing a locking mechanism of the intelligent cabinet system according to the first embodiment of the present invention.
Figure 5:
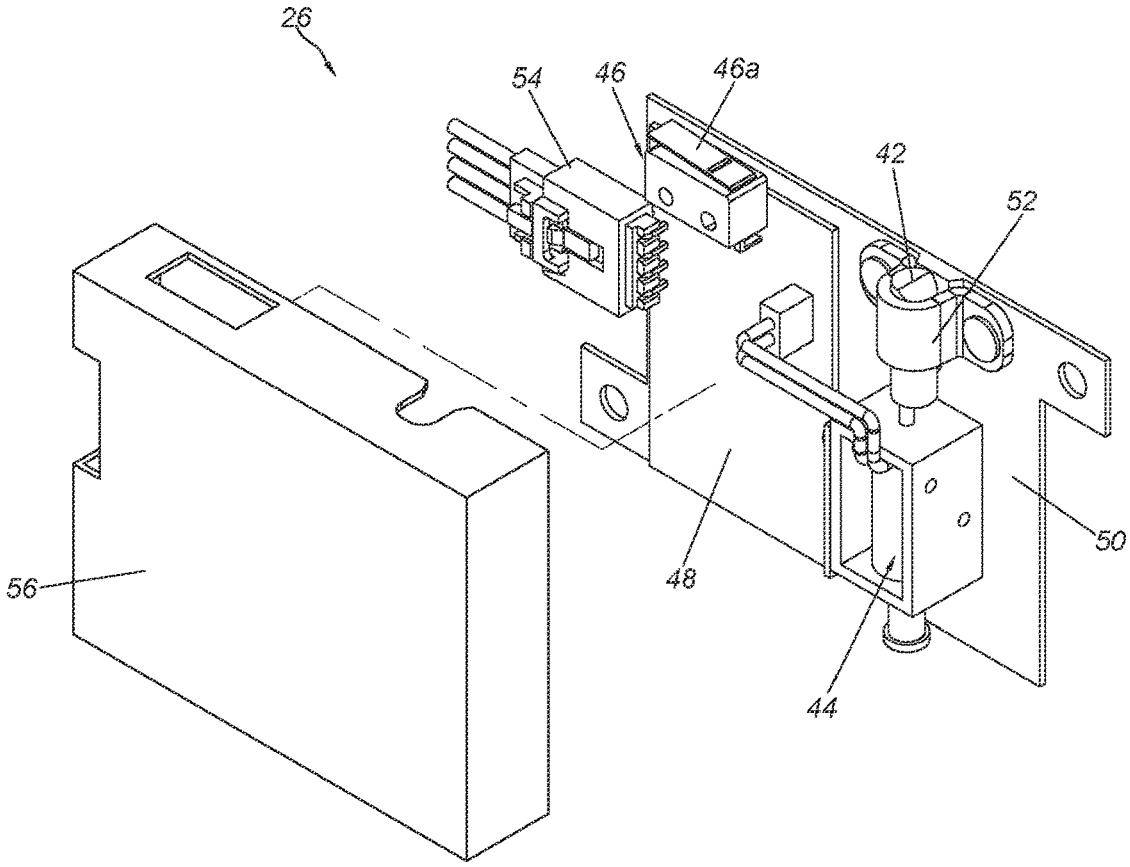
FIG. 5 is an exploded view of the locking mechanism of the intelligent cabinet system according to the first embodiment of the present invention.

As shown in FIG. 4 and FIG. 5, the locking mechanism 26 comprises a locking member 42. Preferably, the locking mechanism 26 further comprises a driving device 44, a sensor 46 and a circuit board assembly 48. The driving device 44 and the sensor 46 are electrically connected to the circuit board assembly 48. The driving device 44 is configured to drive the locking member 42.

Preferably, the driving device 44 comprises a solenoid or a motor, but the present invention is not limited thereto.

Preferably, the sensor 46 can be an electronic switch, such as a proximity switch or a micro switch, but the present invention is not limited thereto. In the present embodiment, the sensor 46 comprises an elastic sensing part 46*a*.

Preferably, the locking mechanism 26 further comprises a substrate 50. The substrate 50 is configured to carry at least one of the circuit board assembly 48 and the driving device 44. In the present embodiment, the substrate 50 is configured to carry the circuit board assembly 48 and the driving device 44, but the present invention is not limited thereto.

Preferably, the locking mechanism 26 further comprises a fixing base 52 to the substrate 50. In the present embodiment, the fixing base 52 has an arc contour, but the present invention is not limited thereto. The fixing base 52 is formed with a space configured to allow the locking member 42 to insert therein, and the fixing base 52 is configured to keep or stabilize a moving direction of the locking member 42.

Preferably, the locking mechanism 26 further comprises a connector 54 electrically connected to the circuit board assembly 48, and the connector 54 is configured to be electrically connected to related electronic components, an external power supply, or the controller 28. Or, in other embodiments, the controller 28 can be arranged on the circuit board assembly 48, but the present invention is not limited thereto.

Preferably, the locking mechanism 26 further comprises a housing 56. The housing 56 is configured to partially of fully cover the locking member 42, the driving device 44, the sensor 46, the circuit board assembly 48, the substrate 50, the fixing base 52 and the connector 54, in order to protect the related components.

Figure 6:
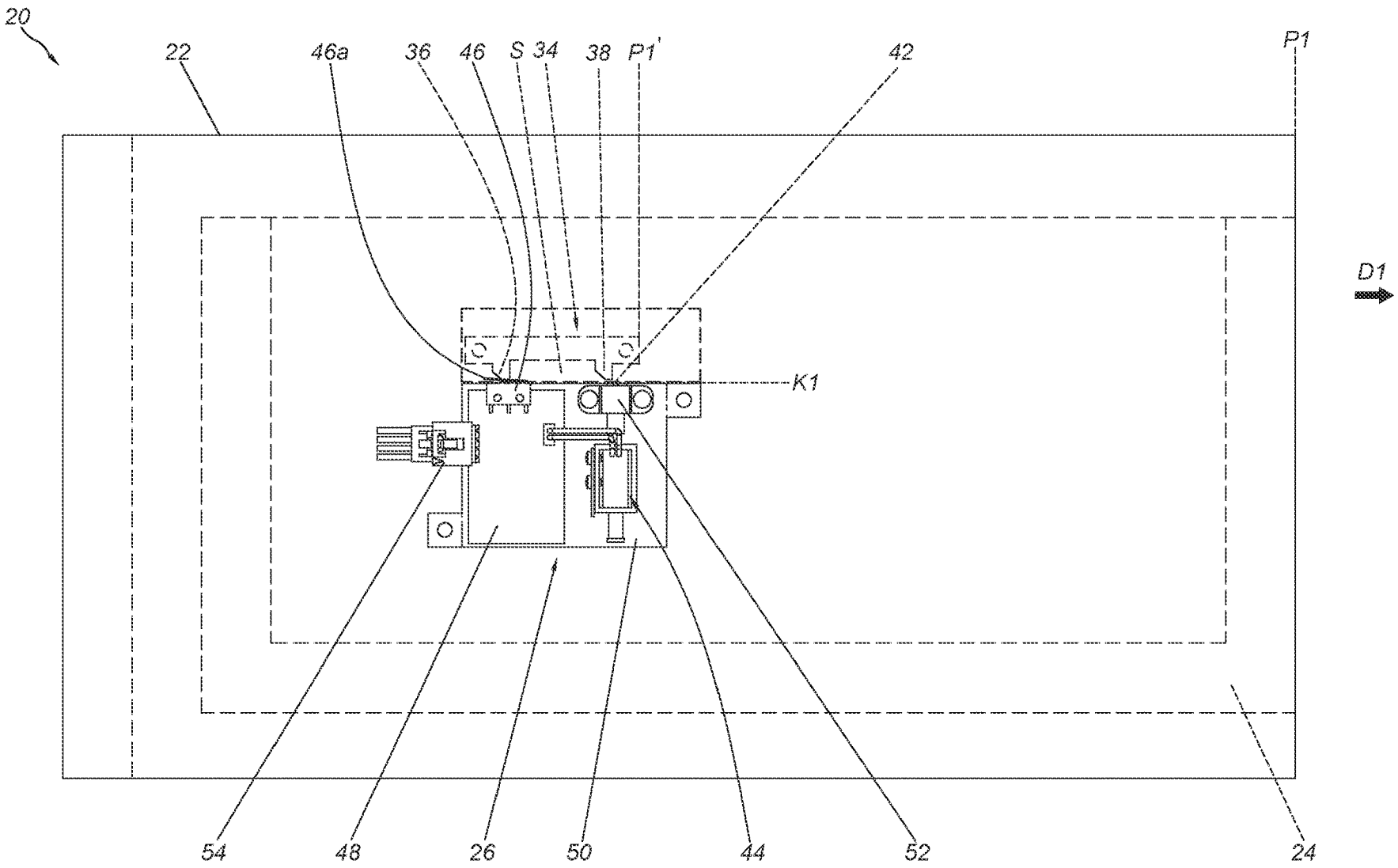
FIG. 6 is a diagram showing a second object of the intelligent cabinet system being in a retracted state relative to a first object according to the first embodiment of the present invention.
Figure 7:
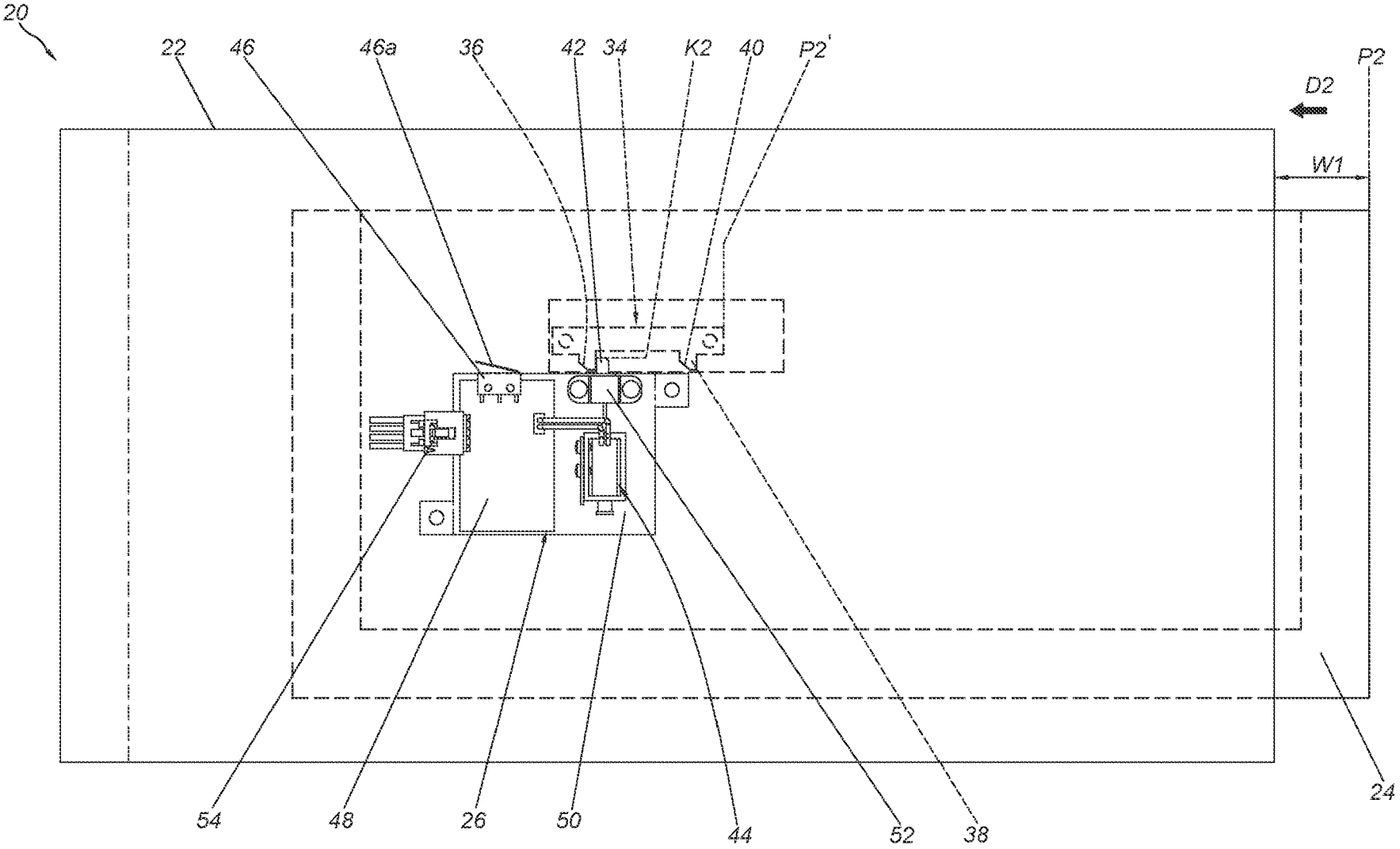
FIG. 7 is a diagram showing the second object of the intelligent cabinet system being slightly opened relative to the first object but still locked according to the first embodiment of the present invention.
Figure 8:
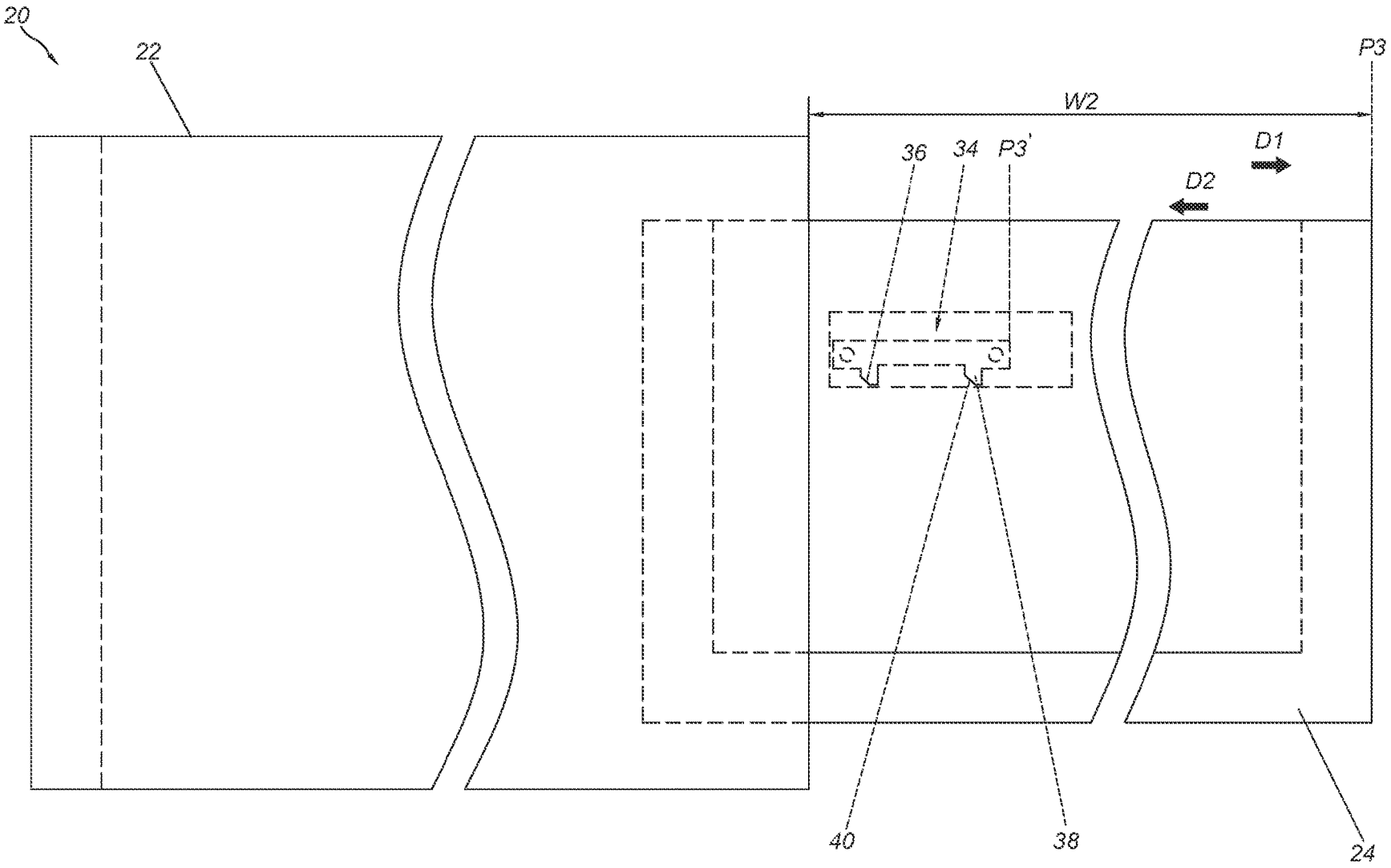
FIG. 8 is a diagram showing the second object of the intelligent cabinet system being completely opened relative to the first object according to the first embodiment of the present invention.

As shown in FIG. 6, FIG. 7 and FIG. 8 (and FIG. 11, FIG. 12 and FIG. 13), the second object 24 is configured to be located at one of a retracted position P1 (as shown in FIG. 6), a predetermined extension position P2 (as shown in FIG. 7) and an open position P3 (as shown in FIG. 8) relative to the first object 22. On the other hand, when the second object 24 is located at the retracted position P1, the locking buckle 34 is located at a position P1' relative to the locking mechanism 26; when the second object 24 is located at the predetermined extension position P2, the locking buckle 84 located at a position P2' relative to the locking mechanism 26; and when the second object 24 is located at the open position P3, the locking buckle 34 is located at a position P3' relative to the locking mechanism 26. The predetermined extension position P2 is located between the retracted position P1 and the open position P3. For example, the predetermined extension position P2 can be any intermediate position between the retracted position P1 and the open position P3. Preferably, the retracted position P1 is a completely retracted position and the open position P3 is a completely open position.

The locking mechanism 26 is arranged on the first object 22, and the locking buckle 34 is arranged on the second object 24. A main body part of the locking mechanism 26 is not shown in FIG. 8. The electronic device 30 is configured to transmit a first control signal or a second control signal to the controller 28 electrically connected to the driving device 44 of the locking mechanism 26. For example, the electronic device 30 can be installed with an application program (APP) having a first setting mode and a second setting mode, such that the electronic device 30 can communicate with the controller 28 for transmitting the first control signal or the second control signal to the controller 28. The controller 28 can determine whether to drive the locking member 42 of the locking mechanism 26 according to a sensing status of the sensor 46.

Figure 11:
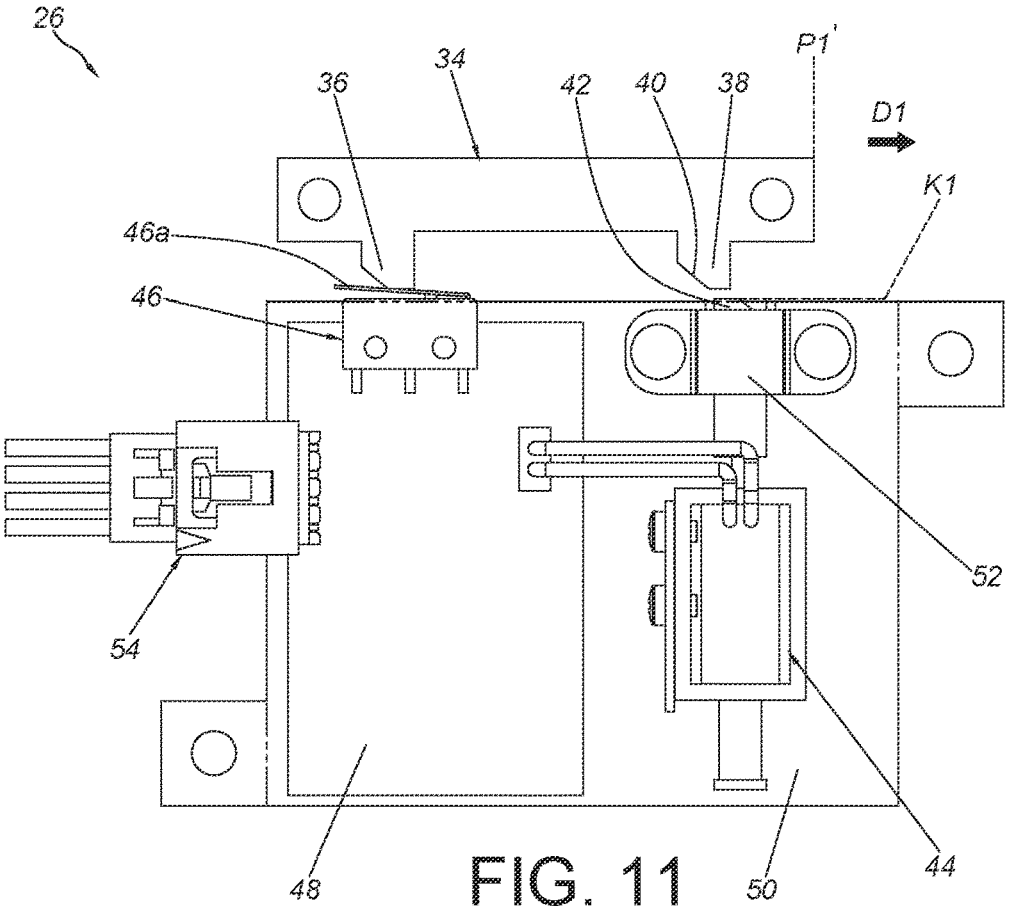
FIG. 11 is a diagram showing the second object of the intelligent cabinet system being located at a retracted position relative to the locking mechanism according to the first embodiment of the present invention.
Figure 12:
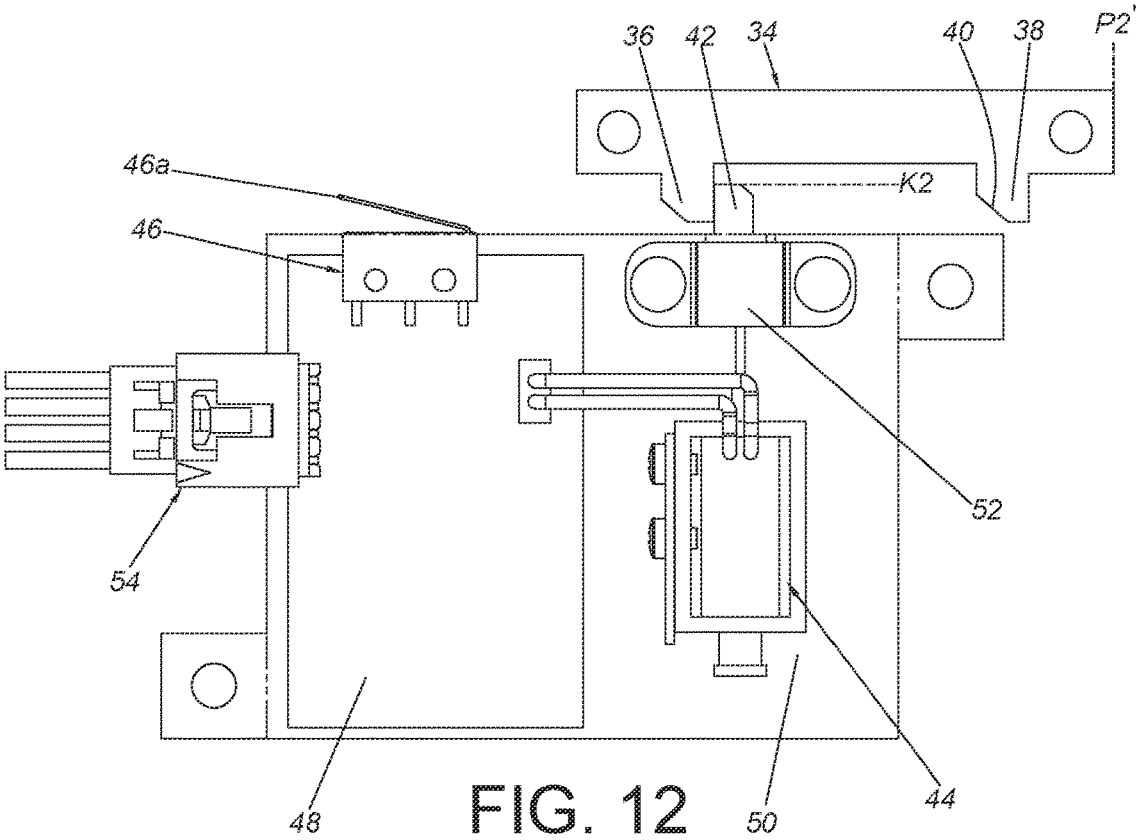
FIG. 12 is a diagram showing the second object of the intelligent cabinet system being located at a predetermined extension position relative to the locking mechanism according to the first embodiment of the present invention.

In the first setting mode, when the electronic device 30 transmits the first control signal (such as a locking signal) to the controller 28, the controller 28 is configured to control the locking member 42 of the locking mechanism 26 to move from a first predetermined position K1 (as shown in FIG. 6 or FIG. 11) to a second predetermined position K2 (as shown in FIG. 7 or FIG. 12) according to the first control signal and the sensing status of the sensor 46. Therefore, when the second object 24 is moved relative to the first object 22 from the retracted position P1 along an opening direction D1, the locking member 42 of the locking mechanism 26 is driven to move to the second predetermined position K2, such that the locking member 42 is configured to block the second object 24 at the predetermined extension position P2 (as shown in FIG. 7 or FIG. 12).

Preferably, the fixing base 52 is configured to keep the moving, direction of the locking member 42 perpendicular to a moving direction of the locking buckle 34.

Preferably, when the locking member 42 of the locking mechanism 26 is located at the second predetermined position K2, the locking member 42 of the locking mechanism 26 is configured to block the first part 36 of the locking buckle 34, such that the second object 24 is blocked at the predetermined extension position P2.

Preferably, during a process of the second object 24 being moved from the predetermined extension position P2 along a retracting direction D2, the guiding feature 40 of the second part 38 of the locking buckle 34 is configured to drive the locking member 42 to move from the second predetermined position K2 back to the first predetermined position K1, so as to allow the second object 24 to return to the retracted position P2.

Therefore, in the first setting mode, when the intelligent cabinet system 20 encounters an earthquake or is shaken by an external force to open the second object 24 from the retracted position P1 along the opening direction D1, the sensor 46 can sense a moving state of the second object 24, and the locking member 42 of the locking mechanism 26 is moved to the second predetermined position K2 by the controller 28. The locking member 42 is configured to block the second object 24 at the predetermined extension position P2, such that the second object 24 is allowed to be opened only a first predetermined distance W1 relative to the first object 22 to be located at the predetermined extension position P2 (as shown in FIG. 7 or FIG. 12). Therefore, items stored in the second object 24 (such as a drawer) can be prevented from falling out, or the second object 24 can be prevented from being suddenly opened a second predetermined distance W2 that is longer than the first predetermined distance W1 to be located at the open position P3 and hurting people or items around it. Therefore, in the first setting mode, the intelligent cabinet system 20 can provide protection and increase safety.

Figure 13:
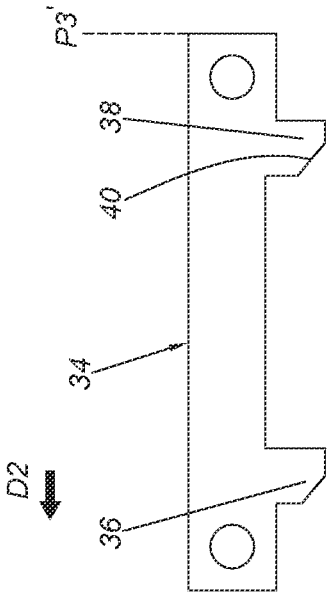
FIG. 13 is a diagram showing the second object of the intelligent cabinet system being located at an open position relative to the locking mechanism according to the first embodiment of the present invention.
Figure 13:
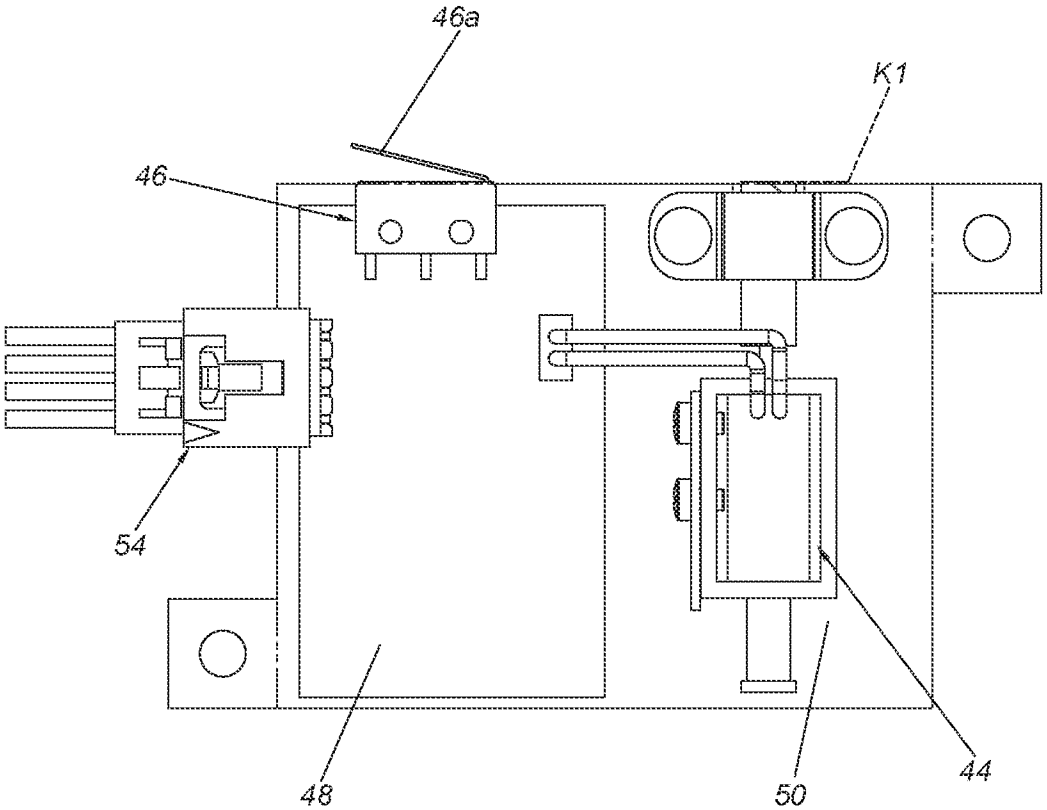

Alternatively, in the second setting mode, when the electronic device 30 transmits the second control signal (such as an unlocking signal) to the controller 28, the controller 28 is configured to control the locking member 42 of the locking mechanism 26 to stay at the first predetermined position K1 (as shown in FIG. 6 or FIG. 11) according to the second control signal and the sensing status of the sensor 46. When the second object 24 is moved relative to the first object 22 from the retracted position P1 along the opening direction D1, the second object 24 is not blocked by the locking member 42 at the predetermined extension position P2 and is movable along the opening direction D1 directly to the open position P3 (as shown in FIG. 8 or FIG. 13). Or, the second object 24 can be moved from the open position P3 to the retracted position P1 along the retracting direction D2.

Preferably, the sensor 46 is configured to provide a first sensing signal or a second sensing signal. The sensor 46 is configured to detect whether the second object 24 is located at the retracted position P1. For example, when the second object 24 is located at the retracted position P1 relative to the first object 22, the second object 24 is configured to press the elastic sensing part 46*a* through the first part 36 of the locking buckle 34, such that the sensor 46 is configured to generate the second sensing signal and the elastic sensing part 46*a* accumulates an elastic force (as shown in FIG. 6 and FIG. 11). Or, when the second object 24 is moved away from the retracted position P1 along the opening direction D1, the first part 36 of the locking buckle 34 on the second object 24 no longer presses the elastic sensing part 46*a*, such that the sensor 46 is configured to generate the first sensing signal and the elastic sensing part 46*a* releases the elastic force. Therefore, the controller 28 can determine that the second object 24 is moved away from the retracted position P1 (as shown in FIG. 7 or FIG. 12) according to the first sensing signal.

Furthermore, in the first setting mode, when the second object 24 is located at the retracted position P1, the locking member 42 is located at the first predetermined position K1 (as shown in FIG. 6 or FIG. 11). When the second object 24 is moved away from the retracted position P1 along the opening direction D1, the sensor 46 is configured to generate the first sensing signal accordingly (as shown in FIG. 7 or FIG. 12), and when the controller 28 determines that the second object 24 is moved away from the retracted position P1 according to the first sensing signal, the controller 28 is configured to control the locking member 42 of the locking mechanism 26 to move from the first predetermined position K1 to the second predetermined position K2 according to the first control signal in order to block the second object 24 at the predetermined extension position P2 (as shown in FIG. 7 or FIG. 12).

Preferably, the power storage device 32 (please refer to FIG. 1) is configured to supply power to the driving device 44. In the first setting mode, when the controller 28 receives the first control signal and the second object 24 is moved away from the retracted position P1 along the opening direction D1, the driving device 44 (or an electromagnet inside the driving device 44) is powered, such that the driving device 44 (or a driving member of the driving device 44) is configured to drive the locking member 42 to move from the first predetermined position K1 to the second predetermined position K2. Alternatively, in the second setting mode, when the controller 28 receives the second control signal, the driving device 44 (the electromagnet inside the driving device 44) is not powered even if the second object 24 is moved away from the retracted position P1 along the opening direction D1. Therefore, the driving device 44 is not configured to drive the locking member 42 to move in the second setting mode, such that the locking member 42 stays at the first predetermined position K1. In the second setting mode, the driving device 44 is not powered, such that the power storage device 32 can provide power for a longer time. Even in the first setting mode, as long as the second object 24 is not opened and moved along the opening direction D1, power of the power storage device 32 is not consumed. Therefore, the first setting mode and the second setting mode are power-saving.

Preferably, in the first setting mode, when the controller 28 determines that the second object 24 is moved away from the retracted position P1 for a predetermined time according to the first sensing signal provided by the sensor 46, the controller 28 is configured to transmit a notification signal to the electronic device 30. Therefore, a user can be notified through the electronic device 30 that the second object 24 is opened due to unexpected reasons (such as encountering an earthquake or being shaken by an external force or others) in order to warn the user. The notification signal can be an electronic message (such as a text message or email), a sound or a light change generated by the electronic device 30, but the present invention is not limited thereto.

Figure 9:
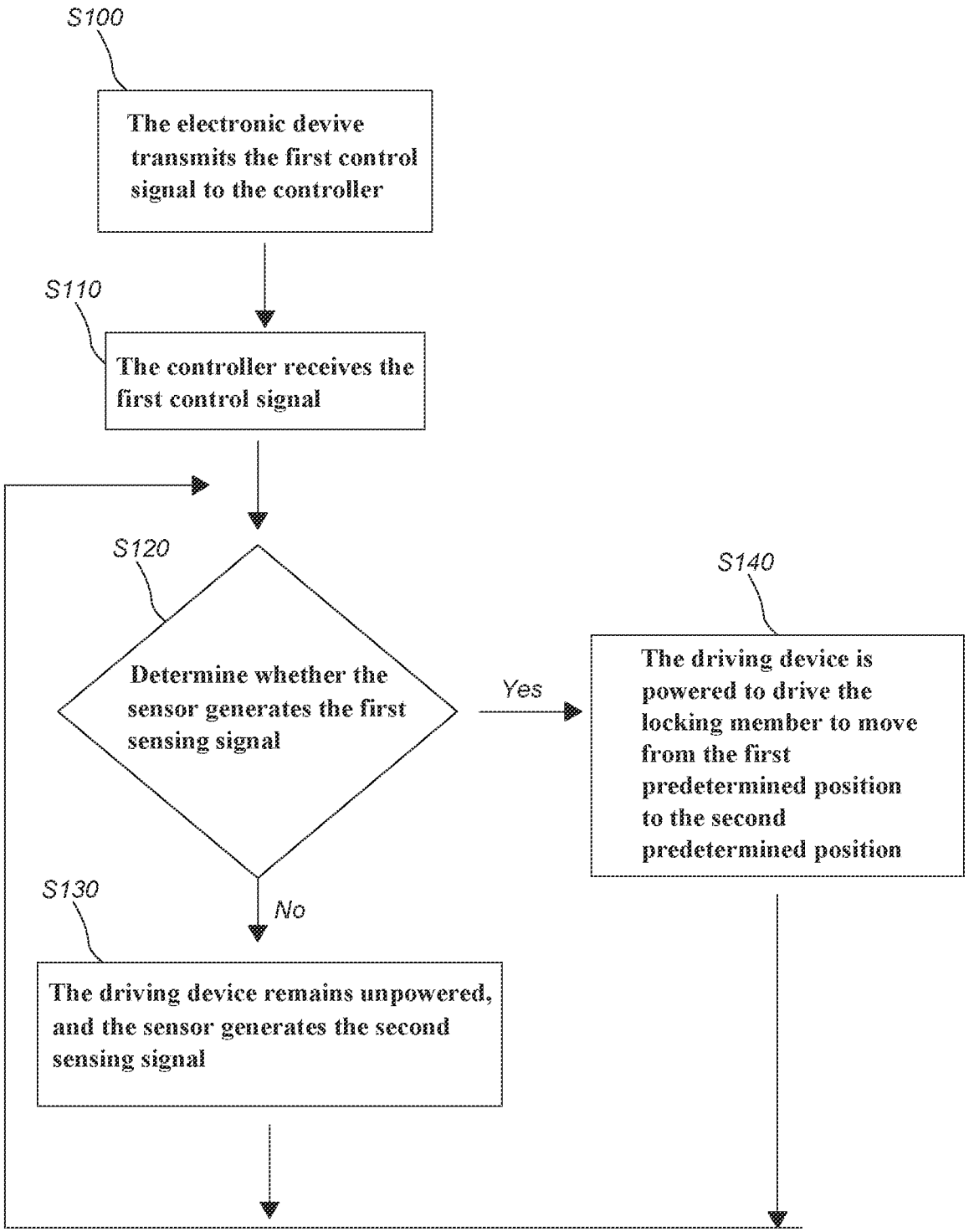
FIG. 9 is a flowchart of operation of the intelligent cabinet system in a first setting mode according to the first embodiment of the present invention.

FIG. 9 is a flowchart of operation of the intelligent cabinet system 20 in the first setting mode. The first setting mode comprises the following steps:

Step S100: The electronic device 30 transmits the first control signal to the controller 28;

Step S110: The controller 28 receives the first control signal;

Step S120: Determine whether the sensor 46 generates the first sensing signal (in step S120, the controller 28 is configured to determine whether the sensor 46 generates the first sensing signal); if yes, go to step 140; if no, go to step 130;

Step S130: If the controller 28 determines that the sensor 46 does not generate the first sensing signal, the driving device 44 remains unpowered, and the sensor 46 generates the second sensing signal (in step S130, when the sensor 46 generates the second sensing signal, it means that the second object 24 is located at the retracted position P1; in addition, when the driving device 44 remains unpowered, the locking member 42 stays at the first predetermined position K1);

Step S140: If the controller 28 determines that the sensor 46 generates the first sensing signal, the driving device 44 is powered to drive the locking member 42 to move from the first predetermined position K1 to the second predetermined position K2 (in step S140, when the sensor 46 generates the first sensing signal, it means that the second object 24 is moved away from the retracted position P1; in addition, when the driving device 44 is powered, the driving device 44 is configured to drive the locking member 42 to move from the first predetermined position K1 to the second predetermined position K2, such that the second object 24 is only allowed to be opened to the predetermined extension position P2).

Details of the aforementioned steps of the first setting mode have been previously illustrated according to FIG. 1 to FIG. 8. For simplification, no further illustration is provided.

Figure 10:
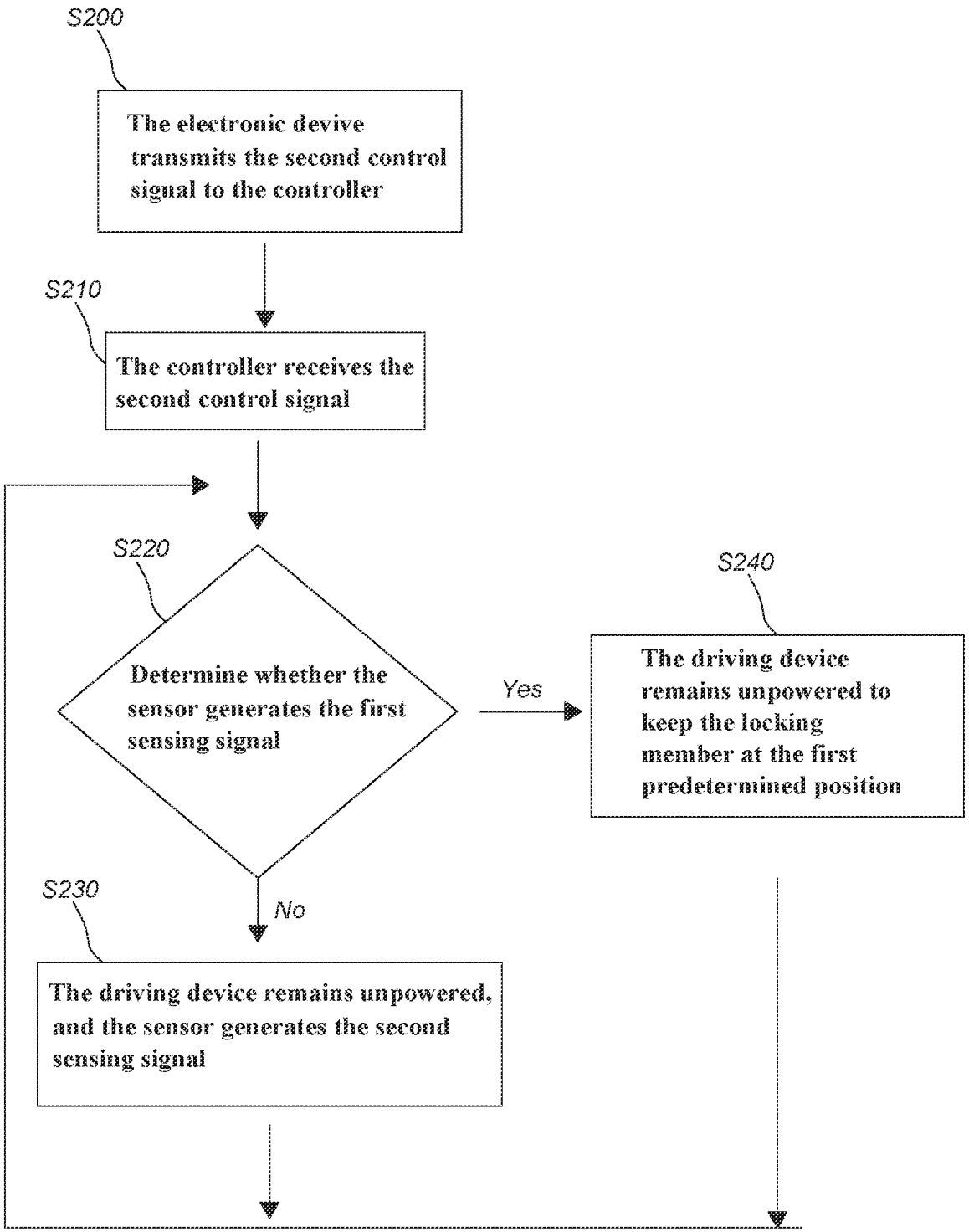
FIG. 10 is a flowchart of operation of the intelligent cabinet system in a second setting mode according to the first embodiment of the present invention.

FIG. 10 is a flowchart of operation of the intelligent cabinet system 20 in the second setting mode. The second setting mode comprises the following steps:

Step S200: The electronic device 30 transmits the second control signal to the controller 28;

Step S210: The controller 28 receives the second control signal;

Step S220: Determining whether the sensor 46 generates the first sensing signal (in step S220, the controller 28 is configured to determine whether the sensor 46 generates the first sensing signal); if yes, go to step 240; if no, go to step 230;

Step S230: If the controller 28 determines that the sensor 46 does not generate the first sensing signal, the driving device 44 remains unpowered, and the sensor 46 generates the second sensing signal (in step S230, when the sensor 46 generates the second sensing signal, it means that the second object 24 is located at the retracted position P1; in addition, when the driving device 44 remains unpowered, the locking member 42 stays at the first predetermined position K1);

Step S240: If the controller 28 determines that the sensor 46 generates the first sensing signal, the driving device 44 remains unpowered to keep the locking member at the first predetermined position (in step S230, when the sensor 46 generates the first sensing signal, it means that the second object 24 is moved away from the retracted position P1; in addition, when the driving device 44 is not powered, the locking member 42 stays at the first predetermined position K1, such that the second object 24 is allowed to be opened to the open position P3).

Details of the aforementioned steps of the second setting mode have been previously illustrated according to FIG. 1 to FIG. 8. For simplification, no further illustration is provided.

In addition, the electronic device 30 can further transmit a disable control signal to the controller 28. When the controller 26 receives the disable control signal, the controller 28 is configured to disable the sensor 46 (such as controlling the power storage device 32 to stop supplying power to the sensor 46) and stops determining whether the sensor 46 generates the first sensing signal. In other words, steps 120 to 140 and steps 220 to 240 are not performed when the controller 28 receives the disable control signal. Therefore, power consumption can be further reduced. On the other hand, the intelligent cabinet system 20 can return to the first setting mode or the second setting mode after the user uses the electronic device 30 to transmit the first control signal or the second control signal to the controller 28.

Figure 14:
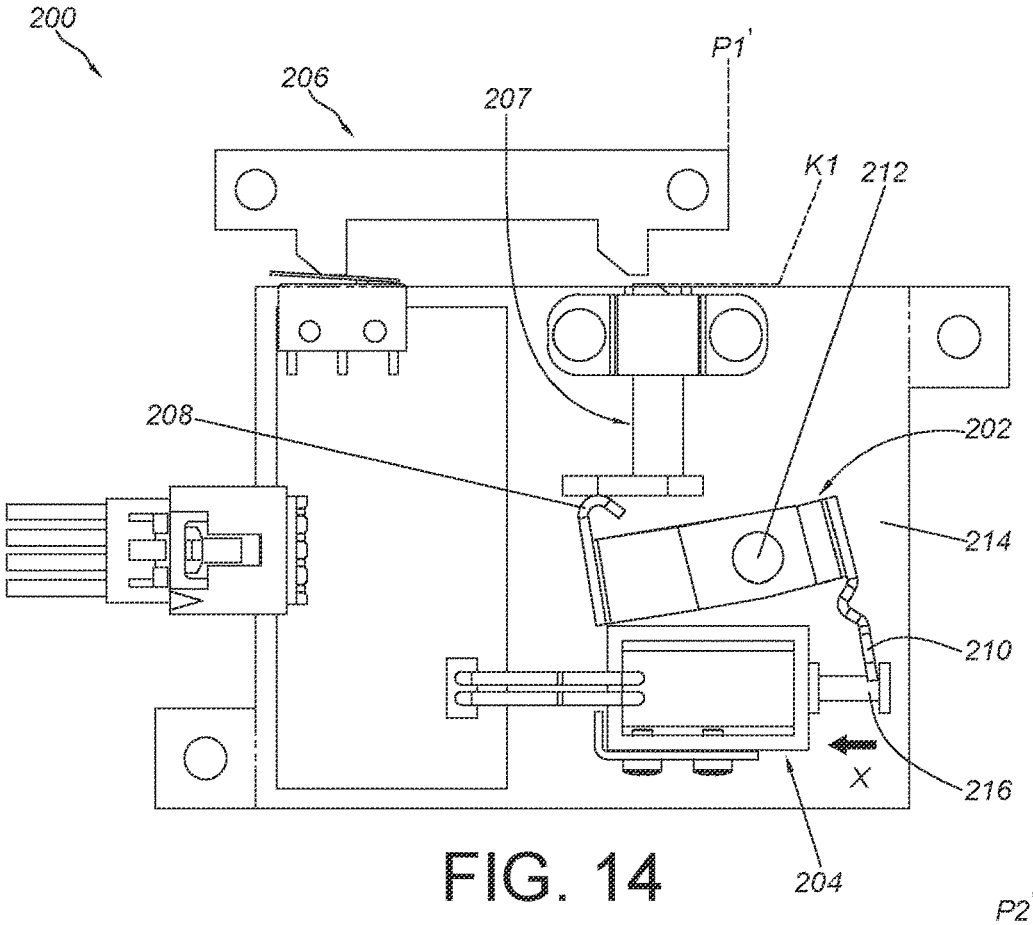
FIG. 14 is a diagram showing the second object of the intelligent cabinet system being located at the retracted position relative to the locking mechanism according to a second embodiment of the present invention.
Figure 15:
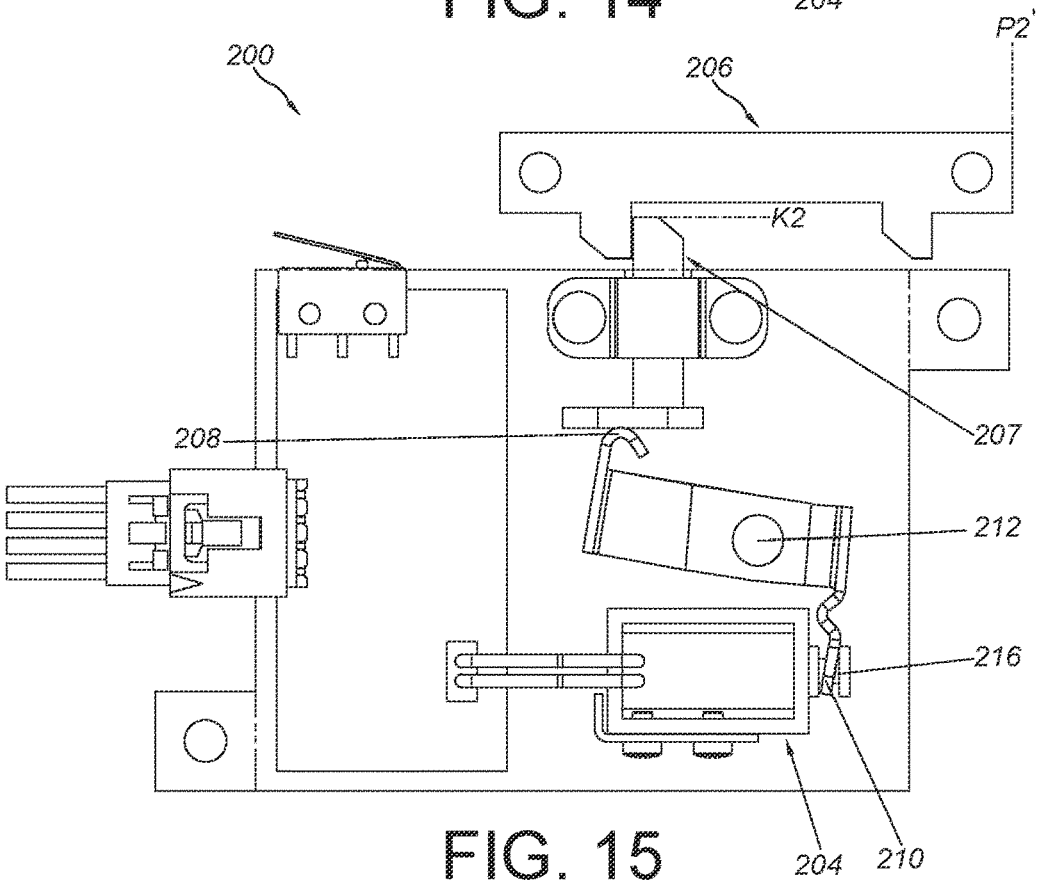
FIG. 15 is a diagram showing the second object of the intelligent cabinet system being located at the predetermined extension position relative to the locking mechanism according to the second embodiment of the present invention.

FIG. 14 and FIG. 15 are diagrams showing a locking mechanism 200 according to a second embodiment of the present invention. A difference between a locking mechanism 200 of the second embodiment and the locking mechanism 26 of the first embodiment is that the locking mechanism 200 further comprises a rotating mechanism 202, and the driving device 204 is arranged in a direction substantially parallel to a longitudinal direction of a locking buckle 206.

Furthermore, the rotating mechanism 202 is arranged between the driving device 204 and the locking member 207, and the rotating mechanism 202 comprises a first contact part 208, a second contact part 210 and a connecting part 212 pivoted to a substrate 214. The connecting part 212 is located between the first contact part 208 and the second contact part 210. The first contact part 206 corresponds to a locking buckle 206, and the second contact part 210 corresponds to a driving member 216 of the driving device 204.

When the controller receives the first control signal and the driving device 204 is powered, the driving device 204 is configured to drive the locking member 207 to move from the first predetermined position K1 (as shown in FIG. 14) to the second predetermined position K2 (as shown in FIG. 15) through the rotating mechanism 202. For example, when the controller receives the first control signal and the driving device 204 is powered, the driving member 216 of the driving device 204 is moved along a linear direction X (such as a longitudinal direction) to be contact the second contact part 210, such that the rotating mechanism 202 rotates a predetermined angle to drive the locking member 207 to move from the first predetermined position K1 to the second predetermined position K2 through the first contact part 208.

Figure 16:
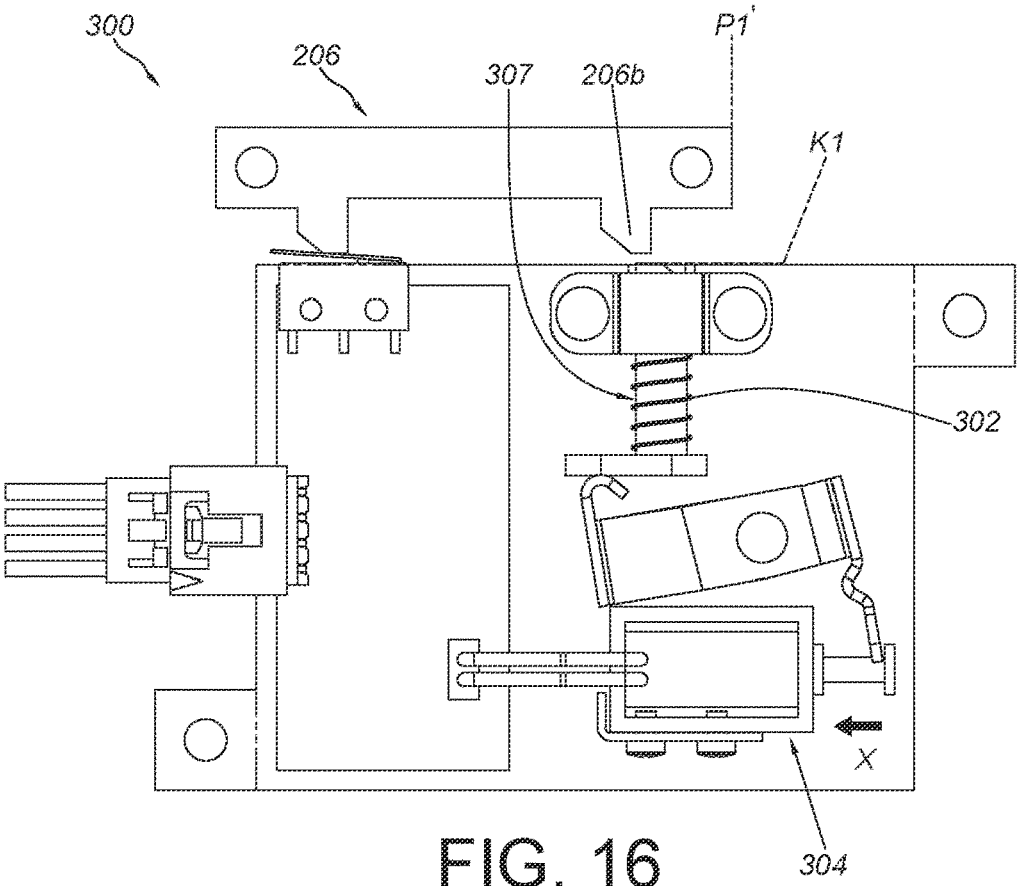
FIG. 16 is a diagram showing the second object of the intelligent cabinet system being located at the retracted position relative to the locking mechanism according to a third embodiment of the present invention.
Figure 17:
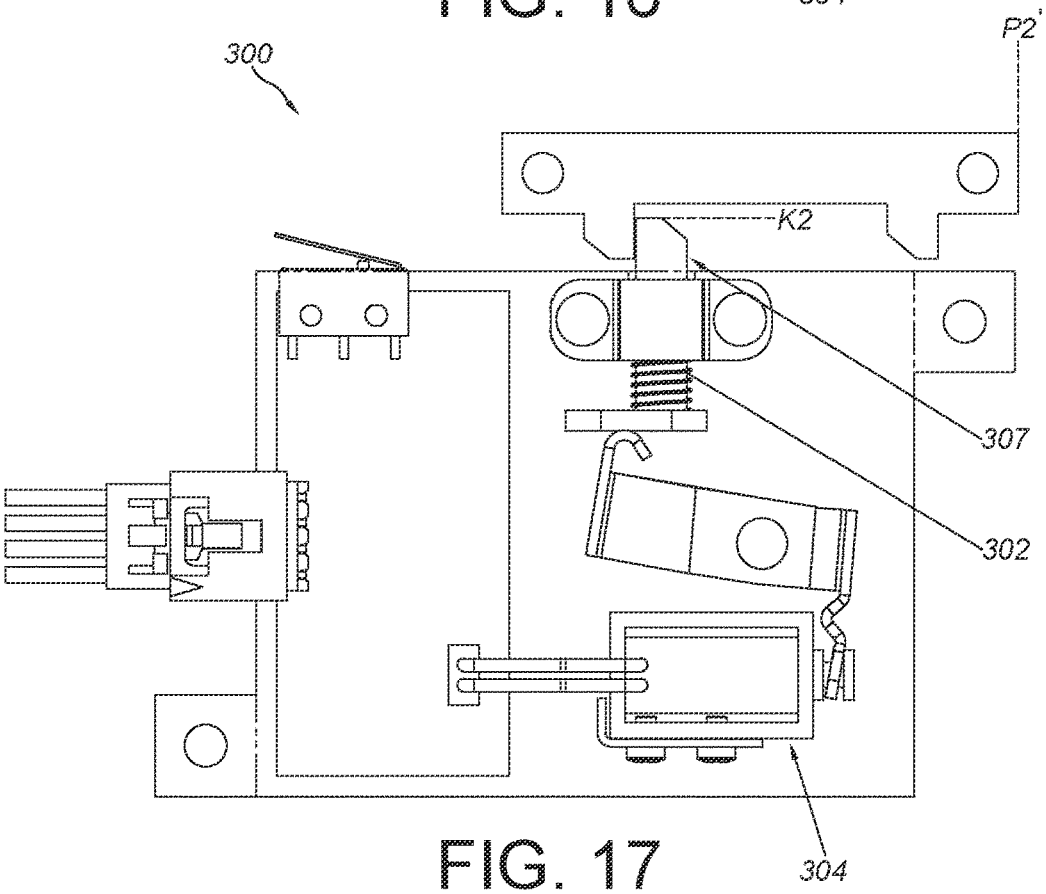
FIG. 17 is a diagram showing the second object of the intelligent cabinet system being located at the predetermined extension position relative to the locking mechanism according to the third embodiment of the present invention.

FIG. 16 and FIG. 17 are diagrams showing a locking mechanism 300 according to a third embodiment of the present invention. A difference between a locking mechanism 300 of the third embodiment and the locking mechanism 200 of the second embodiment is that the locking mechanism 300 further comprises an elastic member 302. When the controller receives the second control signal, the driving device 304 is not powered, and a locking member 307 is configured to be held at the first predetermined position K1 in response to an elastic force of the elastic member 302. Therefore, through arrangement of the elastic member 302, the second part 206*b* of the locking buckle 206 can be omitted.

Figure 18:
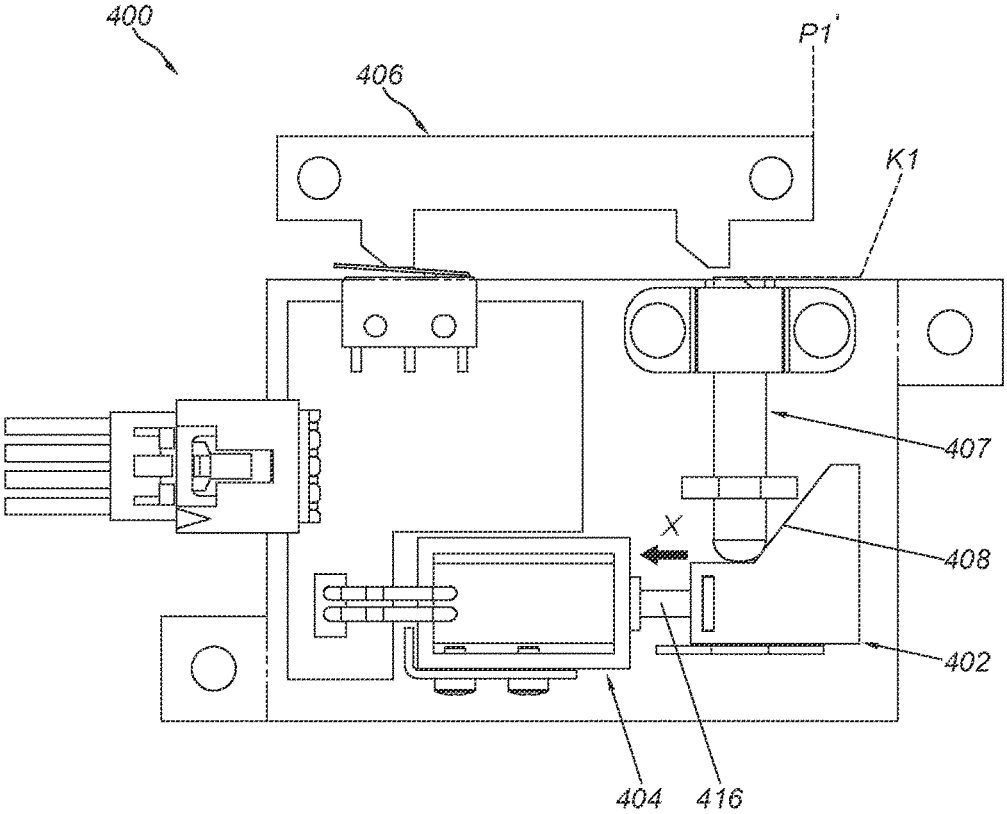
FIG. 18 is a diagram showing the second object or the intelligent cabinet system being located at the retracted position relative to the locking mechanism according to a fourth embodiment of the present invention.
Figure 19:
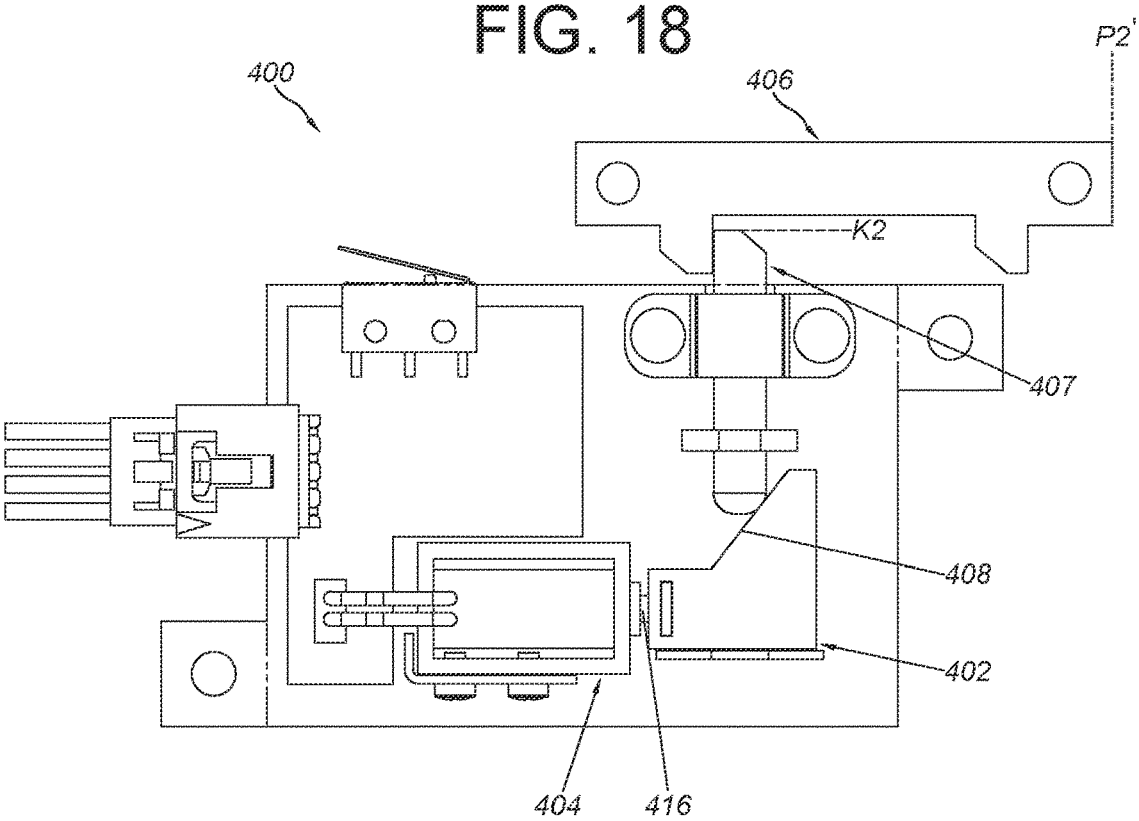
FIG. 19 is a diagram showing the second object of the intelligent cabinet system being located at the predetermined extension position relative to the locking mechanism according to the fourth embodiment of the present invention.

FIG. 18 and FIG. 19 are diagrams showing a locking mechanism 400 according to a fourth embodiment of the present invention. A difference between a locking mechanism 400 of the fourth embodiment and the locking mechanism 26 of the first embodiment is that the locking mechanism 400 further comprises a sliding block 402 and a driving device 404 is arranged in a direction substantially parallel to a longitudinal direction of the locking buckle 406.

Furthermore, the sliding block 402 is arranged between the driving device 404 and a locking member 407. The sliding block 402 is fixed to a driving member 416 of the driving device 404, and the sliding block 402 has a guiding part 408. The guiding part 408 has an inclined surface or an arc surface. The driving device 404 is configured to drive the locking member 407 to move from the first predetermined position K1 to the second predetermined position K2 through the sliding block 402.

Figure 20:
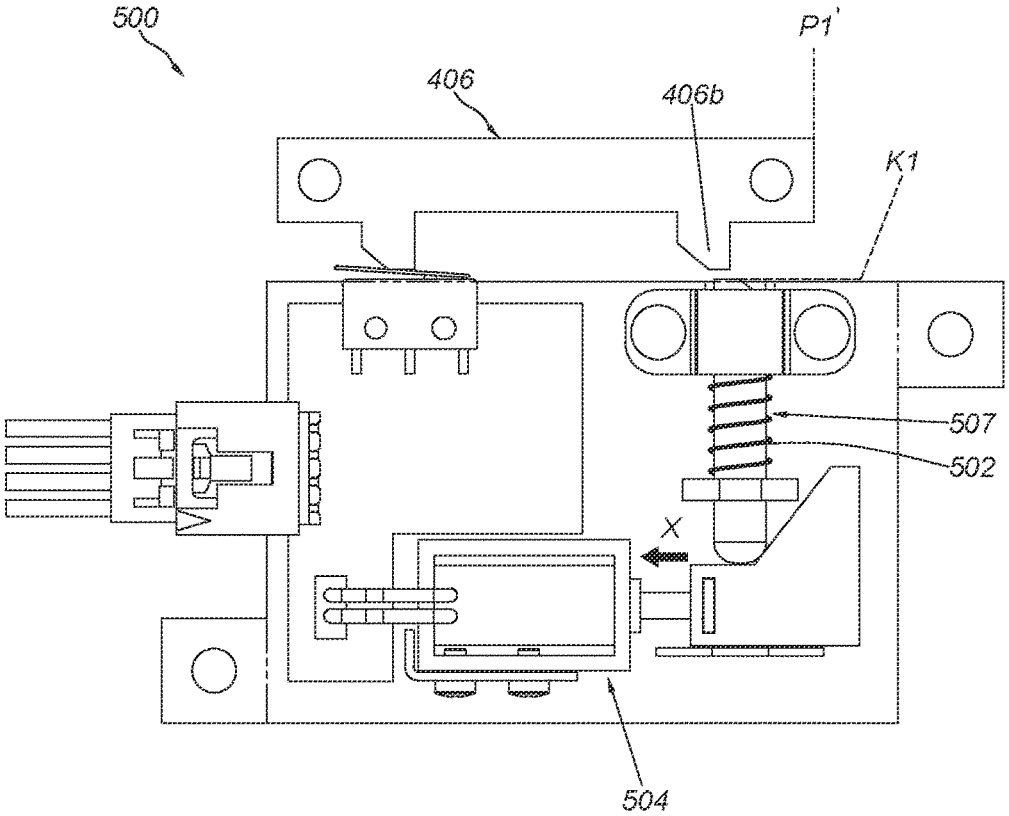
FIG. 20 is a diagram showing the second object of the intelligent cabinet system being located at the retracted position relative to the locking mechanism according to a fifth embodiment of the present invention.
Figure 21:
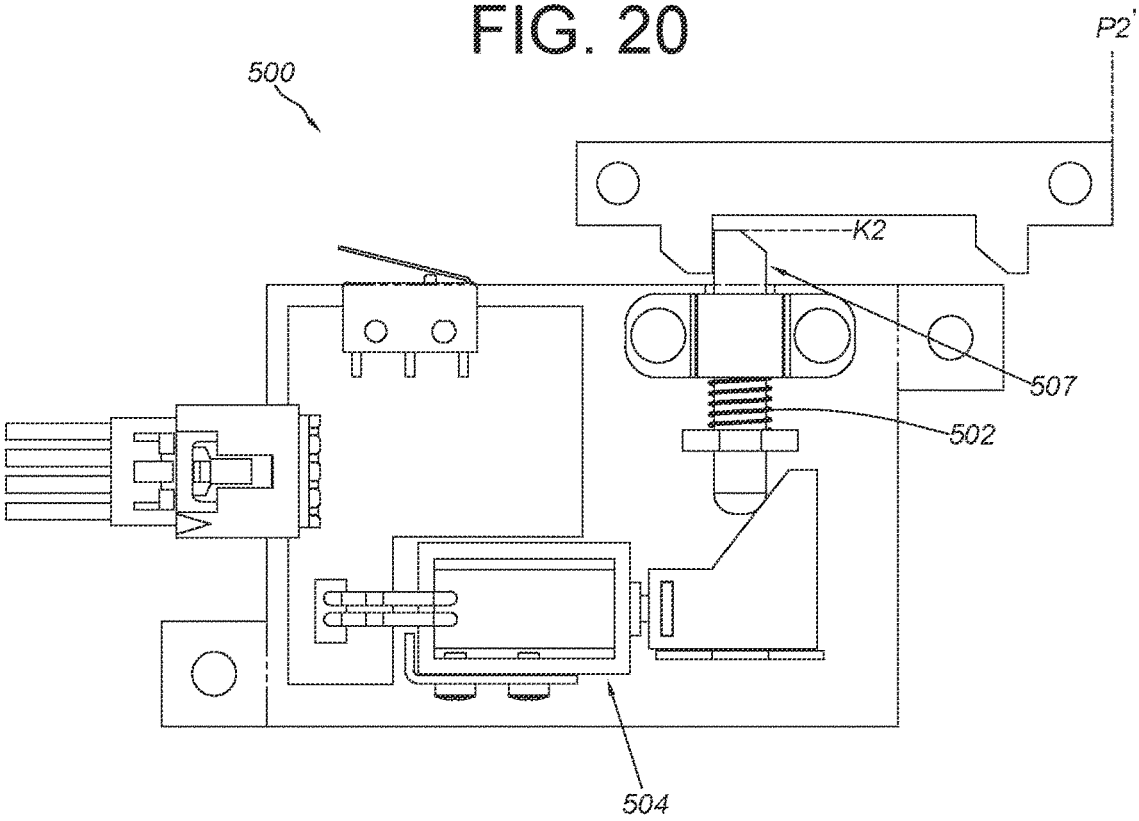
FIG. 21 is a diagram showing the second object of the intelligent cabinet system being located at the predetermined extension position relative to the locking mechanism according to the fifth embodiment of the present invention.

FIG. 20 and FIG. 21 are diagrams showing a locking mechanism 500 according to a fifth embodiment of the present invention. A difference between a locking mechanism 500 of the fifth embodiment and the locking mechanism 400 of the fourth embodiment is that the locking mechanism 500 further comprises an elastic member 502. When the controller receives the second control signal, the driving device 504 is not powered, and a locking member 507 is configured to be held at the first predetermined position K1 in response to an elastic force of the elastic member 502. Therefore, through arrangement of the elastic member 502, the second part 406*b* of the locking buckle 406 can be omitted.

Therefore, the intelligent cabinet system 20 and the locking mechanism 26 (200, 300, 400, 500) used in the system according to the embodiments of the present invention have the following technical features:

1. In the first setting mode, when the intelligent cabinet system 20 encounters an earthquake or is shaken by an external force to open the second object 24 from the retracted position P1 along the opening direction D1, the locking member 42 of the locking mechanism 26 is driven to move to the second predetermined position K2 to block the second object 24 at the predetermined extension position P2, such that the second object 24 is allowed to be opened only a first predetermined distance W1 relative to the first object 22 to be stopped at the predetermined extension position P2 (as shown in FIG. 7 or FIG. 12). Therefore, in the first setting mode, the intelligent cabinet system 20 can provide protection and increase safety.
2. According to the first and second setting modes, the driving device 44 is not be powered in the second setting mode, such that the power storage device 32 can provide power for a longer time due to lower power consumption. Even in the first setting mode, as long as the second object 24 is not opened and moved along the opening direction, power of the power storage device 32 is not consumed. Therefore, the first and second setting modes are power-saving.
3. When the controller 28 determines that the second object 24 is moved away from the retracted position P1 for a predetermined time according to the first sensing signal provided by the sensor 46, the controller 28 is configured to transmit a notification signal to the electronic device 30. Therefore, the user can be notified through the electronic device 30 that the second object 24 is opened due to unexpected reasons (such as encountering an earthquake or being shaken by an external force or others) in order to warn the user.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. An intelligent cabinet system, comprising:

a first object;

a second object movable relative to the first object;

a locking mechanism comprising a locking member; and a controller configured to communicate with an electronic device for receiving a first control signal from the electronic device;

wherein the second object is movable relative to the first object from a retracted position to an open position;

wherein when the electronic device transmits the first control signal to the controller, and when the second object is moved relative to the first object from the retracted position along an opening direction, the controller is configured to control the locking member of the locking mechanism to move from a first predetermined position to a second predetermined position according to the first control signal, in order to block the second object at a predetermined extension position by the locking member;

wherein the predetermined extension position is located between the retracted position and the open position.

2. The intelligent cabinet system of claim 1, wherein the first object is a cabinet body, and the second object is a drawer or a door.

3. The intelligent cabinet system of claim 1, wherein the electronic device and the controller are configured to communicate with each other through wireless transmission.

4. The intelligent cabinet system of claim 1, wherein the locking mechanism further comprises a sensor configured to detect whether the second object is located at the retracted position.

5. The intelligent cabinet system of claim 4, wherein when the second object is located at the retracted position, the locking member is located at the first predetermined position; wherein when the second object is moved away from the retracted position along the opening direction, the sensor is configured to generate a first sensing signal accordingly; and wherein when the controller determines that the second object is moved away from the retracted position according to the first sensing signal, the controller is configured to control the locking member of the locking mechanism to move from the first predetermined position to the second predetermined position according to the first control signal in order to block the second object at the predetermined extension position.

6. The intelligent cabinet system of claim 5, wherein when the controller determines that the second object is moved away from the retracted position for a predetermined time according to the first sensing signal, the controller is configured to transmit a notification signal to the electronic device.

7. The intelligent cabinet system of claim 1, wherein when the electronic device transmits a second control signal to the controller, the controller is configured to control the locking member of the locking mechanism to be located at the first predetermined position according to the second control signal, to allow the second object to move along the opening direction to the open position without being blocked at the predetermined extension position by the locking member.

8. The intelligent cabinet system of claim 7, further comprising a power storage device, wherein the locking mechanism further comprises a driving device, and the power storage device is configured to supply power to the driving device.

9. The intelligent cabinet system of claim 8, wherein when the controller receives the first control signal and the driving device is powered, the driving device is configured to drive the locking member to move from the first predetermined position to the second predetermined position; wherein when the controller receives the second control signal, the driving device is not powered, and the locking member is located at the first predetermined position.

10. The intelligent cabinet system of claim 1, further comprising a locking buckle, wherein the locking mechanism is arranged on one of the first object and the second object, and the locking buckle is arranged on the other one of the first object and the second object; wherein when the locking member of the locking mechanism is located at the second predetermined position, the locking member of the locking mechanism is configured to block the locking buckle, in order to block the second object at the predetermined extension position.

11. A locking mechanism configured to be mounted to one of a first object and a second object movable relative to each other, the second object being movable relative to the first object to be located at one of a retracted position, a predetermined extension position and an open position, the locking mechanism comprising:

a locking member; and a driving device configured to drive the locking member to move from a first predetermined position to a second predetermined position;

wherein when the second object is moved relative to the first object from the retracted position along an opening direction and when the locking member is located at the second predetermined position, the locking member is configured to block the second object at the predetermined extension position;

wherein the predetermined extension position is located between the retracted position and the open position.

12. The locking mechanism of claim 11, wherein when the second object is moved relative to the first object from the retracted position along the opening direction and when the locking member is located at the first predetermined position, the second object is movable along the opening direction to the open position without being blocked at the predetermined extension position by the locking member.

13. The locking mechanism of claim 12, further comprising a sensor configured to detect whether the second object is located at the retracted position.

14. The locking mechanism of claim 13, further comprising a power storage device configured to supply power to the driving device.

15. The locking mechanism of claim 14, wherein the locking mechanism comprises a controller configured to receive a first control signal or a second control signal of an electronic device; wherein when the controller receives the first control signal and the second object is moved away from the retracted position along the opening direction, the driving device is powered and configured to drive the locking member to move from the first predetermined position to the second predetermined position; wherein when the controller receives the second control signal and the second object is moved away from the retracted position along the opening direction, the driving device is not powered such that the locking member is located at the first predetermined position.

16. The locking mechanism of claim 15, further comprising a rotating mechanism, wherein the driving device is configured to drive the locking member to move from the first predetermined position to the second predetermined position through the rotating mechanism.

17. The locking mechanism of claim 16, further comprising an elastic member; wherein when the controller receives the second control signal and the second object is moved away from the retracted position along the opening direction, the driving device is not powered, and the locking member is held at the first predetermined position in response to an elastic force of the elastic member.

18. The locking mechanism of claim 15, further comprising a sliding block, wherein the driving device is configured to drive the locking member to move from the first predetermined position to the second predetermined position through the sliding block.

19. The locking mechanism of claim 18, further comprising an elastic member; wherein when the controller receives the second control signal and the second object is moved away from the retracted position along the opening direction, the driving device is not powered, and the locking member is held at the first predetermined position in response to an elastic force of the elastic member.

20. The locking mechanism of claim 11, further comprising a locking buckle and a fixing base; wherein the locking buckle is arranged on the other one of the first object and the second object; wherein when the locking member of the locking mechanism is moved from, the first predetermined position to the second predetermined position, the locking member of the locking mechanism is configured to block the locking buckle, in order to block the second object at the predetermined extension position; wherein the fixing base is configured to keep a moving direction of the locking member perpendicular to a moving direct on of the locking buckle.

* * * * *